US005481467A

United States Patent [19]

Smith et al.

[11] Patent Number: 5,481,467

[45] Date of Patent: Jan. 2, 1996

[54] CONTROLLING THE OPERATION OF A TOOL ALONG A PREDETERMINED PATH

[75] Inventors: James A. Smith, Gilmorton; Alfred R. Corbett, Birstall; Graham N. Tolton, Leicester, all of England

[73] Assignee: British United Shoe Machinery Ltd., Leicester, England

[21] Appl. No.: 238,577

[22] Filed: May 5, 1994

Related U.S. Application Data

[63] Continuation of Ser. No. 873,296, Apr. 23, 1992, abandoned.

[30] Foreign Application Priority Data

May 1, 1991 [GB] United Kingdom ..... 9109422
May 9, 1991 [GB] United Kingdom ..... 9110061

[51] Int. Cl.[6] ..... G05B 19/18

[52] U.S. Cl. ..... 364/474.28; 364/474.22; 69/6.5

[58] Field of Search ..... 364/474.12–474.17, 364/474.21, 474.25, 474.28, 474.35, 188, 474.22–474.27, 474.09; 69/6.5; 83/74; 318/568; 118/696

[56] References Cited

U.S. PATENT DOCUMENTS

| | | | |
|---|---|---|---|
| 4,133,235 | 1/1979 | Gerber | 83/74 |
| 4,452,057 | 6/1984 | Davies et al. | 69/6.5 |
| 4,541,054 | 9/1985 | Peck et al. | 318/568 |
| 4,564,914 | 1/1986 | Ballough et al. | 364/474.14 |
| 4,660,148 | 4/1987 | Kishi et al. | 364/188 |
| 4,666,352 | 5/1987 | Nagao et al. | 364/474.14 |
| 4,680,719 | 7/1987 | Kishi et al. | 364/474.14 |
| 4,698,573 | 10/1987 | Niwa | 364/474.14 |
| 4,836,139 | 6/1989 | Davies | 118/696 |
| 5,043,907 | 8/1991 | Richards | 364/474.09 |

*Primary Examiner*—James P. Trammell

[57] ABSTRACT

For controlling the progressive operation of a tool along a predetermined path, wherein at least one operating parameter relating to the operation of the tool can be varied during the progressive operation thereof, a limited number of values for said at least one parameter is pre-set, each value being provided with an identification by which, in a path-determining mode, at each of a plurality of selected points along said path (defined by coordinate axis values for said path) one such value can be selected, the coordinate axis values together with the selected identification being stored for subsequent recall. By way of example, the operating parameter(s) may be the speed of rotation of and/or the pressure applied to a tool of a shoe bottom roughing machine using the speed of rotation of a rotary brush assembly forming part of an adhesive-applying tool assembly and/or the flow rate of adhesive supplied to the adhesive-applying tool in an adhesive-applying machine.

14 Claims, 5 Drawing Sheets

CONTROLLING THE OPERATION OF A TOOL ALONG A PREDETERMINED PATH

This is a continuation of application Ser. No. 07/873,296 filed on Apr. 23, 1992, now abandoned.

BACKGROUND OF THE INVENTION

This invention is concerned with a method of controlling the progressive operation of a tool along a predetermined path in relation to a selected portion of a workpiece, wherein at least one operating parameter relating to the operation of the tool can be varied during the progressive operation thereof.

The invention is further concerned with machines for operating progressively along e.g. marginal portions of shoes using a rotary tool, wherein at least one operating parameter relating to the operation of the tool can be varied during the progressive operation thereof.

By way of example only, there is described in EP-A-0 079 695 the U.S. equivalent being U.S. Pat. No. 4,452,057 a machine suitable for use in performing a progressive operation along marginal portions of shoes comprising a shoe support, a tool carrier for supporting a rotary tool, drive means for effecting rotation of such tool, first and second n.c. motor means for effecting relative movement, both lengthwise and widthwise of a shoe supported by the shoe support, between the shoe support and the tool carrier, and third n.c. motor means for controlling the heightwise position of the tool carrier relative to the shoe support, as relative lengthwise and widthwise movement is caused to take place therebetween, each such motor means operating under control of computer control means by which drive signals are generated and supplied to said motor means in accordance with a programmed instruction, including digitised coordinate axis values, using three coordinate axes, for a plurality of selected points along the marginal portion of the or a similar shoe, so that, in an operating mode of the machine, the tool carrier can follow a predetermined path, determined according to the contour of the shoe portion being operated upon, relative to the shoe support, and a tool carried by the tool carrier can thus be caused to operate progressively along a marginal portion of a shoe supported by the shoe support, the machine further comprising path-determining means operable in a path-determining mode of the machine and comprising a control device for causing relative movement to take place along said three coordinate axes between the shoe support and tool carrier to bring them to successive selected points along the marginal portion of such shoe, together with means for digitising, and storing in digitised form, the coordinate axis values of each such selected point. (By "n.c. motor means" where used herein is to be understood means comprising at least one n.c. motor, i.e. a motor the operation of which is controlled by control signals supplied thereto in accordance with digitised information appropriate to the desired operation of the motor. Examples of such motors are stepping motors and d.c. servo motors.)

In such machine, which, as described, is a machine for performing a progressive roughing operation on marginal portions of shoe bottoms, the speed of rotation of the tool remains unchanged during a cycle of operation. It will, however, be appreciated that as the tool progresses along different sections of the marginal portions of a shoe bottom, different operating parameters may be required in order to ensure a uniform degree of roughing of the whole of the marginal portions. For example, the upper may be made of different materials in different regions of the shoe and the different materials may well be more or less sensitive to the action of the roughing tool. It has been the practice over a number of years to vary in pre-selected regions of the marginal portions of the shoe bottom, the roughing pressure, i.e. the pressure by which the roughing tool is urged against the shoe bottom. In general, however, the sections have been pre-defined and not readily alterable, so that the applied pressure could not always be set appropriately to the sensitivity of the material being roughed. This therefore led to compromises in the roughing quality.

Similarly, there is described in EP-A-0 351 993 a machine for performing a progressive adhesive-applying operation to selected portions of components, e.g. shoes, wherein, in the same manner as described with reference to the aforementioned roughing machine, n.c. motor means is provided for effecting relative movement along three coordinate axes, between a shoe support and tool supporting means of said machine. In the adhesive-applying machine, moreover, the tool is an adhesive-applying tool incorporating a rotary brush assembly, means being provided for supplying adhesive to the adhesive-applying tool.

In such machine the rotary brush assembly is caused to rotate during the adhesive-applying operation firstly so that it spreads the adhesive over the area to be subsequently bonded and secondly so that it has a "scrubbing" effect which assists penetration of the adhesive into the material of the shoe upper. In said machine, furthermore, the speed of rotation of the brush assembly is pre-defined and cannot be altered during the machine cycle of operation. With different shoe upper materials, however, it has been found that the optimum speed of rotation of the brush assembly varies so that in using a single pre-defined speed for applying adhesive to shoes having uppers made of different materials compromise is frequently necessary.

OBJECTS OF THE INVENTION

It is thus one of the various objects of the present invention to provide an improved method of controlling the progressive operation of a tool along a predetermined path, in using which method a greater degree of flexibility is achieved than has previously been available for varying one or more operating parameters relating to the operation of the tool during the progressive operation thereof.

It is another of the various objects of the present invention to provide an improved machine suitable for operating progressively along marginal portions of workpieces, e.g. shoes, wherein greater flexibility is provided by enabling at least one operating parameter relating to the operation of a tool of such machine to be varied during the progressive operation thereof.

SUMMARY OF THE INVENTION

The invention thus provides, in one of its several aspects, a method as set out in the first paragraph above, characterised in that for the at least one parameter a limited number of values is pre-set, each such value being provided with an identification, in that in a path-determining mode, in which selected points along said path are defined by determining coordinate axis values thereof, one such identification is selected for each such point, and the coordinate axis values together with the selected identification are stored for subsequent recall, the coordinate axis values and identifications for all the selected points thus constituting a programmed instruction for the operation of the tool, and in that when the programmed instruction is progressively implemented, and the tool thus caused to operate along its path, said at least one operating parameter is varied in accordance with the values, selected via the identifications, for successive selected points.

It will thus be appreciated that, using such a method the facility is provided for ensuring that the appropriate value for the at least one parameter can be applied to each selected point along the path of the tool, as deemed most appropriate by an operator. Once the selection has been made, furthermore, the selected value is implemented whenever the programmed instruction is implemented to effect a progressive operation of the tool along its predetermined path.

For further enhancing the flexibility thus achieved, furthermore, conveniently the limited number of values for the at least one parameter is selected from a range of such values therefor, each of the selected values being allocated to an identification. Moreover, preferably in an editing mode the values allocated to the identifications can be individually altered and/or can be varied as a group.

The invention further provides, in another of its several aspects, a machine suitable for operating progressively along marginal portions of shoes, as set out in the third paragraph above, which machine is characterised in that selector means is provided for selecting, for each selected point, a value corresponding to a desired speed of rotation of the tool, and for storing such selected value together with the coordinate axis values of the relevant selected point, said stored values for a set of selected points being supplied to the computer control means as part of a programmed instruction when the machine is in an operating mode, and thus serving to control not only the path of the tool but also the speed of rotation thereof as it is caused to operate progressively along the marginal portions of a shoe supported by the shoe support.

It will thus be appreciated that, using the machine in accordance with the invention, it is now possible to store selected values corresponding to a desired speed of rotation of the tool and, in response to such selections, during an operating cycle of the machine implementing the tool speeds of rotation without any further requirement as regards settings to be made by the operator. In this way, therefore, style data required for a particular shoe may be determined by a person other than the operator and the selection of a particular set of style data automatically sets up the machine and implements said at least one operating parameter contained in the set of style data, again without any interference by the operator or without any need on the part of the operator to make further settings.

In one machine in accordance with the invention, furthermore, a tool is supported by the tool carrier for movement relative thereto heightwise of a shoe supported by the shoe support, resilient means being provided for urging such tool relative to the tool carrier in a direction towards the shoe support, and sensing means is provided, operable in the path-determining mode of the machine, for sensing when the tool is in a predetermined heightwise position in relation to the tool carrier when the latter is moved towards the shoe support by the third n.c. motor means. In such machine, furthermore, preferably further selector means is provided for selecting, for each selected point, a value corresponding to the pressure to be applied by said resilient means to the tool and for storing such value together with the coordinate axis values and "rotation speed" value for the relevant selected point, and thus as part of the programmed instruction. Thus, in using such machine not only are the selected values corresponding to the speeds of rotation of the tool stored but also such values for the pressure to be applied to the tool during an operating cycle, and such tool pressures will then be implemented in the operation of the machine without any further requirement as regards settings to be made by the operator.

More particularly, preferably each "applied pressure" value which can be selected corresponds to an actual pressure within a range of such pressures and has an identification, such that selecting the identification for a pressure in the path-determining mode is effective to cause its corresponding pressure to be applied in the operating mode of the machine. In a preferred embodiment of the invention, furthermore, only a limited number of identifications is provided, the machine further comprising means for selectively associating an actual pressure with each of the identifications; it has been found sufficient for four such identifications to be provided.

In this way, the person compiling the style data is thus able to select various pressures for application at various points within the limited number of identifications provided, and then to associate those pressures with the identifications, this selection itself then being stored as part of the style data. In this way, as already pointed out, the selection of pressures itself thus forms part of the style data.

Similarly, preferably each "rotational speed" value which can be selected corresponds to an actual speed of rotation of the tool within a range of such speeds and has an identification, such that relating the identification for a speed in the path-determining mode is effective, in the operating mode of the machine, to cause the tool to rotate at the speed corresponding to the selected identification. Again, in the case of rotational speed, moreover, a limited number of identifications is provided, the machine further comprising means for selectively associating an actual speed of rotation with each of the identifications; in practice, four such identifications have been found sufficient. It will thus be appreciated that, as with the applied pressure, the settings for the rotational speed thus also form part of the style data.

The applied pressure may well, in an operating mode of the machine, affect the heightwise position of the tool carrier and consequently it is considered desirable that the selective association of actual pressures with identifications is carried out prior to the determination of selected points along the marginal portion of the shoe. With the selective association thus made, moreover, in the path-determining mode selecting an identification as aforesaid for a given point along the shoe marginal portion causes the pressure associated therewith to be applied prior to the digitising and storing of the coordinate axis values for such point. In this way, the actual pressures which have been selected are applied during the "teaching" of the positional values which will form part of the style data, so that in the operating mode of the machine the actual pressures applied have been taken account of during the "teaching", i.e. path determining, mode of the machine.

Where the tool is a radial roughing brush, it will be appreciated, in the course of its use it will gradually wear down, quite apart from the fact that from time to time it undergoes a grinding operation in order to maintain its operating surface at the required degree of sharpness. As a consequence, the diameter of the brush varies considerably as between a new brush and one which is about to be discarded. Consequent upon this change in diameter, it will be appreciated, is a change in the peripheral speed of the brush, which change can thus be significant over the life of the brush. In order to overcome this problem, therefore, preferably means is provided for determining the diameter of the brush, together with speed modifying means whereby the speed rotation of the brush, selected as aforesaid, is modified according to its diameter as determined by the tool diameter determining means. In a preferred embodiment, the drive means for effecting brush rotation comprises an a.c. motor controlled by an inverter. When such drive means is,used, supplying a voltage to the inverter, effects operation of the motor and the output speed of the motor varies with the value of the voltage supplied to the inverter. For varying the speed as the brush wears down, furthermore, the voltage is modified in accordance with a modifying factor representing the diameter of the brush. In this way, therefore, a further modification of the speed (in addition to that effected using the rotation speed values as set) is provided for ensuring that the peripheral speed of the operating portion of the brush is maintained substantially constant regardless of the diameter of the brush.

In a further machine in accordance with the invention, the tool may be an adhesive-applying tool incorporating a rotary brush assembly, means being provided for supplying adhesive to the adhesive-applying tool. Such machine, furthermore, preferably comprises adhesive flow rate control means for controlling the rate of flow of adhesive supplied to the tool, said means comprising a variable pressure regulator arrangement, together with further selector means, operable in the path-determining mode, for selecting, for each selected point, a value corresponding to the pressure to be applied via said pressure regulator arrangement, and thus for selecting a desired adhesive flow rate, and for storing the selected value with the coordinate axis values and "rotation speed" value of the selected point, and thus as part of the programmed instruction.

Using such a machine one problem can be overcome which has previously been experienced with commercially available machines, namely that, in applying adhesive to e.g. marginal portions of shoe bottoms, it has been found that some shoe upper materials absorb the applied adhesive relatively quickly, while in the case of others the adhesive tends to remain unabsorbed, so that the amount of adhesive by which the bond is made will vary according to the material, and in any event the amount of adhesive which is required for bonding will not be the same for every shoe upper material, but rather will be dependent e.g. upon whether the material is a light one or a heavy one, the solution to such problem being achieved by the expedient of varying the adhesive flow rate, and thus the amount of adhesive applied, at different sections of the path of the tool during its progressive operation.

As in the case of the roughing machine described above, furthermore, the various style data required for a particular component may now be determined either by the operator or another person and the selection of a particular set of style data automatically sets up the apparatus and implements the various parameters contained in the set of style data, without any interference by the operator to make further settings. Thus, once the style data for a particular component has been set up, the various settings can be instantly recalled whenever the particular component is to be operated upon.

As in the case of the roughing machine referred to above, furthermore, conveniently each "pressure" value and each "rotational speed" value which can be selected corresponds respectively to an actual pressure within a range of such pressures and an actual rotational speed within a range of such speeds and each has an identification such that selecting the identification in the path-determining mode is effective to cause the corresponding pressure or rotation speed, as the case may be, to be applied in an operating mode of the machine. As previously, furthermore, a limited number of identifications is provided, means being provided for selectively associating an actual pressure or rotational speed, as the case may be, with each of the identifications; it has been found sufficient for four such identifications to be provided.

BRIEF DESCRIPTION OF THE DRAWINGS

There now follows a detailed description, to be read with reference to the accompanying drawings, of two machines in accordance with the invention the operation of each of which is illustrative of a method in accordance with the invention, said machines and method, it will be appreciated, having been selected for description merely by way of non-limiting example of the invention.

In the accompanying drawings.

DESCRIPTION OF THE PREFERRED EMBODIMENT

Figure 1:
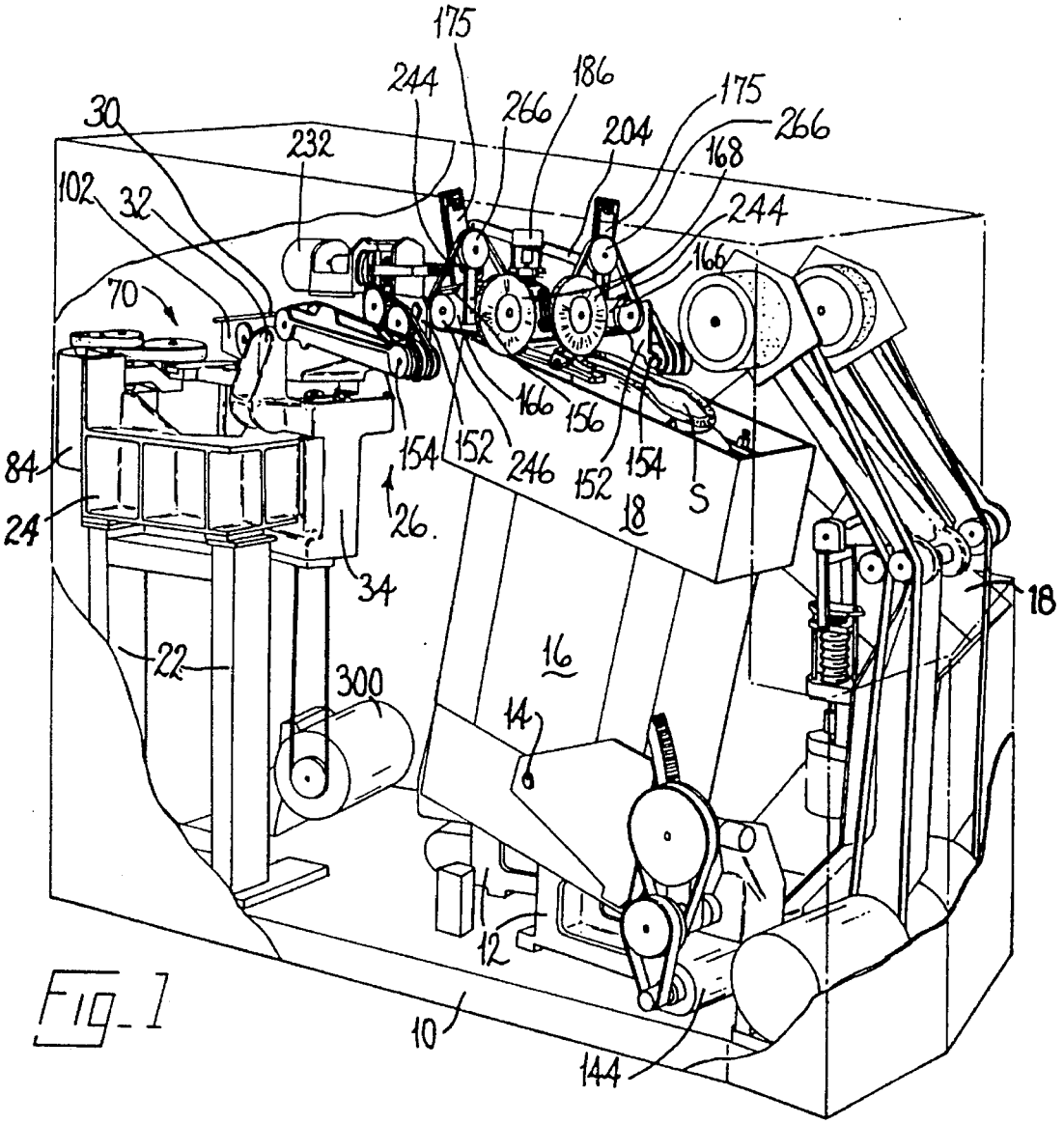
FIG. 1 is a left hand perspective view illustrating features of the machine described in EP-A-0 079 695, which is generally similar, except as hereinafter described, to a first machine in accordance with the invention.
Figure 2:
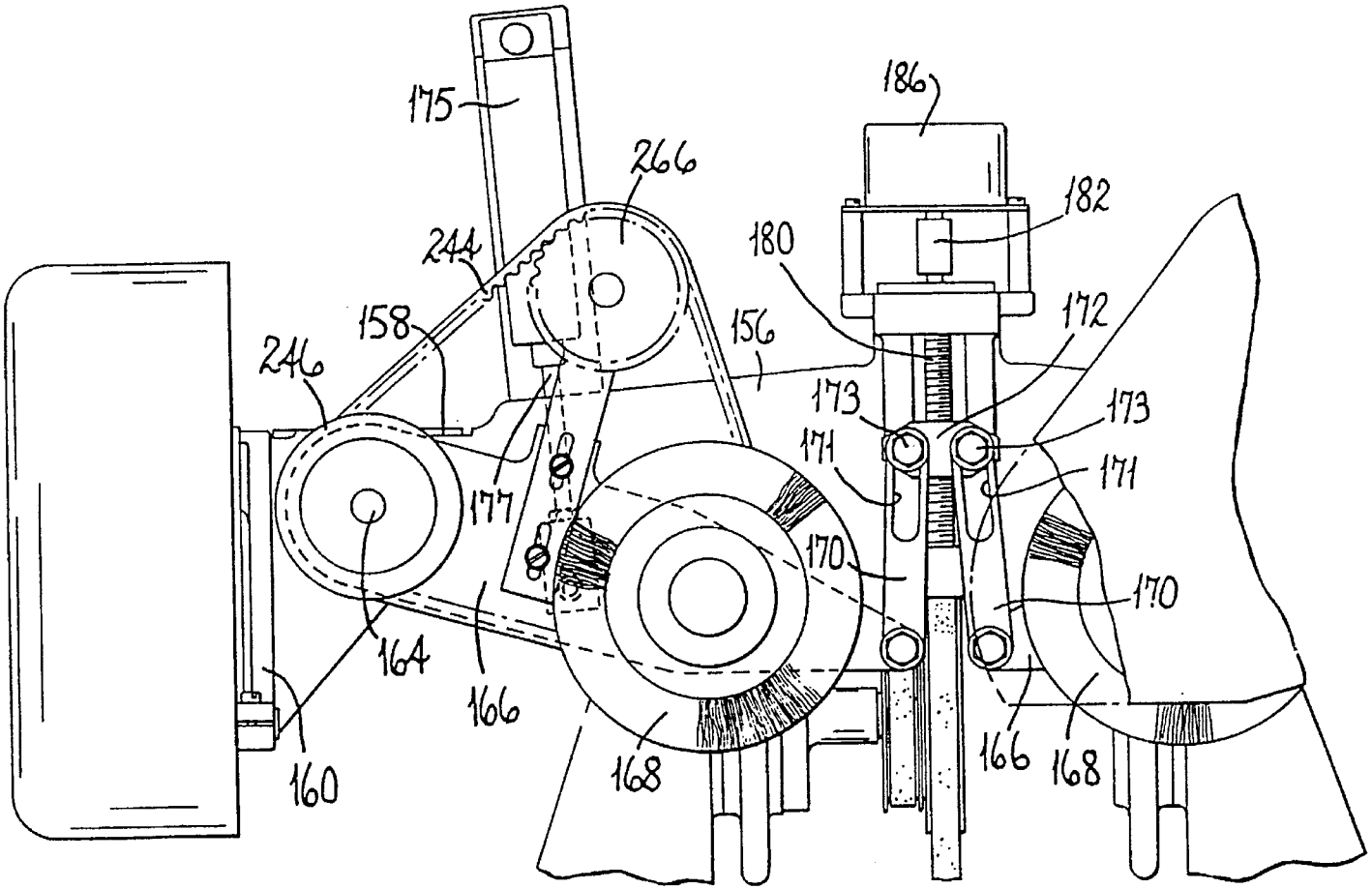
FIG. 2 is a front view, with parts broken away, showing two rotary radial roughing tools and support means therefor, forming part of the machine shown in FIG. 1.

The first machine in accordance with the invention now to be described is generally similar, except as hereinafter described, to the machine described in EP-A-0 079 695, one distinction being that the machine there described (and as shown in FIG. 1) was provided with two shoe supports arranged side-by-side and successively presentable to tools carried by tool supporting means of the machine, whereas in the first machine in accordance with the present invention only one such shoe support is provided.

The machine now to be described thus comprises a base 10 supporting on brackets 12 a pivot shaft 14 which in turn carries a support 16 for a shoe support 18. The shoe support 18 supports a shoe S, bottom uppermost, with the toe end thereof facing towards the front of the machine, i.e. towards the operator. At its rear, the base 10 supports a support column structure 22 carrying a casting on which tool supporting means generally designated 26 is carried. The tool supporting means comprises a bifurcated arm 30 supported, for pivotal movement about a horizontal axis, between upstanding lugs 32 forming part of a support casting 34, the latter casting itself being supported for pivotal movement about a vertical axis. Thus, by moving the shoe support 18 on its associated shaft 14, and further by effecting pivotal movement of the arm 30 about said horizontal and vertical axes, relative lengthwise, heightwise and widthwise movement is effected between the tool supporting means 26 and the shoe support 18.

For effecting such movement of the shoe support 18, furthermore, a first n.c. motor, constituted by a stepping motor 144, is provided, which acts through a drive arrangement 142. Similarly, for effecting movement of the arm 30 about its vertical axis a second n.c. motor constituted by a second stepping motor 84 is provided, acting through a drive arrangement generally designated 70. Again, for effecting movement of the tool supporting arm 30 about its horizontal axis, a third n.c. motor constituted by a stepping motor (not shown) is provided, acting on a rearwardly extending portion 102 of the arm 30.

At its forward end, the arm 30 supports a transversely extending bridge member at opposite ends of which are provided forwardly projecting arms 152, between which is carried, on fulcrum pins 154, a generally U-shaped tool carrier comprising a cross-beam 156, two bevelled gear housings 158, arranged one at either end of the cross-beam, and two forwardly projecting arms 160. Projecting forwardly from each housing 158 is a shaft 164 on which an inwardly extending transverse support arm 166 is pivotally mounted, each arm 166 carrying a rotary radial wire roughing brush 168. The inner end of each support arm 166 has a link 170 pivotally connected thereto, the opposite end of each link 170 having formed therein a slot 171 in which is received a pin 173, whereby pivotal movement of the arm 166 about the shaft 164 is limited. Apart from the weight of the brush 168 urging the slotted end of its associated link 170 downwardly to a limit determined by the pin 173, resilient means, constituted by a pneumatically controlled piston-and-cylinder arrangement 175 is provided effective, when actuated, to urge the link downwardly relative to said pin.

Each pin 173 is mounted in a block 172, itself mounted for limited heightwise sliding movement on a front face of the cross-beam 156. The block 172 threadedly receives a threaded shaft 180 coupled, via a universal coupling 182, to the output drive shaft of a n.c. motor, constituted by a stepping motor 186, supported on the cross-beam 156. Operation of the stepping motor 186 is thus effective to cause the block 172 to be moved heightwise relative to the cross-beam 156, thus to shift the defined heightwise position of each tool 168, and determined by engagement between each pin 173 and the upper end of its associated slot 171. The stepping motor 186 is operated each time a re-set operation takes place, as will be referred to hereinafter.

The tool carrier is mounted for pivotal movement on the fulcrum pins 154, thus to cause the roughing brushes 168 to be tilted bodily therewith about the axis of the fulcrum pins 154. In this way, the plane of each radial brush can be maintained perpendicular, or substantially so, to the plane of the area of the shoe bottom a the time being operated upon. For effecting pivotal movement of the tool carrier about the fulcrum pins 154, furthermore, a still further n.c. motor constituted by a stepping motor 232, is provided, which acts through a rod 204 which in turn is pivotally connected to an up, standing bracket on the cross-beam 156.

Furthermore, the shoe bottom engaging portion of the operating surface of each tool 168 is maintained in such a position that the plane in which the axis of the fulcrum pins 154 is disposed lies tangentially, or substantially so, to such shoe bottom engaging portion when the brushes are in contact with the shoe bottom. In this way, the pivotal movement of the brushes about said axis does not significantly affect the position of the shoe bottom engaging portion of the operating surface of each tool lengthwise, heightwise and widthwise of the shoe bottom.

The roughing brushes 168 are caused to rotate in contrary directions such that each brush, as it is caused to operate progressively along a marginal portion of the shoe bottom, effects an inwiping action on such marginal portion. To this end, drive means is provided in the form of an electric motor 300 (to be referred to hereinafter) mounted on the base 10 of the machine and operating through a system of drive belts and drive pulleys. Said system comprises, for each brush, a pulley 246, mounted on the shaft 164, said pulley 266 carried on the arm 166. By mounting the pulley 246 on the shaft 164, the final drive to the roughing brush 168 will not be affected by any pivotal movement of the arm 166 about said shaft 164.

The first machine in accordance with the invention is computer-controlled, the computer having a storage memory for storing digitised information relating to a number of selected styles of shoe bottom to be operated upon, the operator selecting the appropriate style for the particular shoe to be operated upon in the next cycle of operation; such selection may be through a keyboard (not shown) of the computer. Instead of storage in the computer memory, the digitised information may be stored on a suitable information-carrying medium, e.g. magnetic tape or EEPROM. In such a case, selection of a given style will of course require the appropriate medium to be placed in a reader of the computer. The term "programmed instruction" when used herein is intended to include digitised information particular to a given shoe style, regardless of the manner of its storage.

The computer is effective, in response to the programmed instruction selected, to cause the tool carrier to follow a predetermined path with reference to three coordinate axes relative to the shoe support. Thus, for each digitised point the computer supplies drive signals, in the form of control pulses, to the appropriate stepping motor 144, whereby its associated shoe support 18 is caused to move the shoe bottom beneath the brushes 168, while simultaneously drive signals, also in the form of control pulses, are supplied to the second and third stepping motors for effecting movement of the tool support both widthwise and heightwise of the path of lengthwise movement of the shoe support. In the case of each stepping motor, furthermore, the control pulses are generated and supplied thereto in accordance with a programmed instruction, including digitised coordinate axis values, using three coordinate axes, for a plurality of successive selected points along the marginal portion to be operated upon, such digitised information being stored in the memory of the computer. Similarly, the computer may supply drive signals, in the form of control pulses, to the stepping motor 232, whereby the tool support is caused to pivot about the axis of the fulcrum pins 154 as aforementioned.

The various stepping motors of the machine and also the computer control means thereof may also be utilised in a path-determining mode of the machine whereby the operative path of the tool carrier in relation to the shoe support can be determined. To this end, a model shoe is placed in the shoe support 18 and relative lengthwise, widthwise and heightwise movement is effected between the tool carrier and the shoe support, under operator control, using e.g. a joy-stick (not shown), spaced points of contact being selected between a brush 168 carried by the tool carrier and the shoe bottom supported by the shoe support, and the coordinate axis values of each such selected point being caused to be digitised using the computer control means and to be thereafter stored in the memory of such computer. The method used for determining the path of the tool carrier relative to the shoe support using the machine in accordance with the invention is generally similar, except as hereinafter described, to the method described in U.S. Pat. No. 4,541,054.

When the machine is in an operating mode desirably, according to the type of upper material used in the shoe and also the degree of roughing required, a facility is provided for varying the speed of rotation of the brush 168 and/or the pressure by which it is urged against the shoe under the action of piston-and-cylinder arrangement 175. Moreover, such variation in the speed of rotation and/or roughing pressure should be capable of being made during an operating cycle, not merely as between successive operating cycles. To this end, therefore, the machine in accordance with the invention also provides means for setting the speed of rotation of the brush 168 and/or the roughing pressure as applied through the piston-and-cylinder 175 for each digitised point, as will now be discussed in greater detail.

In the machine in accordance with the invention, the heightwise position of each tool 168 relative to the tool carrier is not fixed, but rather the tool 168 may "float" heightwise in relation to the carrier, thus to accommodate any irregularities in the shoe bottom being operated upon, as compared with the digitised predetermined path. For digitising such path, therefore, it is necessary that the heightwise disposition of each tool 168 relative to the tool carrier be known and to this end, in a path-determining mode of the machine, the operator controls the downward movement of the tool supporting arm 30, and thus of the tool carrier, such that each tool 168 is urged against the shoe bottom, against the action of its associated piston-and-cylinder arrangement 175, such downward movement being discontinued under operator control when the tools reach a defined heightwise position, as sensed by sensing means (not shown), operable in the path-determining mode of the machine, and comprising a fluidic bleed device effective when actuated to operate an indicator lamp which is visible by the operator, so that he can readily detect when the tool is in its defined heightwise position. Alternatively, the fluid bleed device could be used automatically to control the downward movement of the tool carrier as aforesaid. Instead of such an arrangement a relatively simple scale-and-pointer device may be provided.

Bearing in mind, furthermore, that the roughing pressure may affect the relative position of the tool in the tool carrier, preferably the roughing pressure "taught" for each digitised point is applied at said point in the path-determining mode of the machine in order that there will be no discrepancy in the relative positions of the tool and tool carrier as between the path-determining mode and the subsequent operating mode of the machine.

For determining roughing pressures a facility is provided for the operator to select four values P1, P2, P3, P4 from a range of twenty-five pre-set values. Each of these twenty-five values represents a different pressure in a range from zero to 30 psi. The selection of only four values from these twenty-five will be such typically as to allow one pressure to be selected for the toe end of the shoe, another for the heel end, and one each for the side portions of the shoe bottom. By associating a selected pressure with each of the values P1, P2, P3, P4, the "teaching" procedure can then be significantly simplified.

At the same time, although the speed of rotation of the brush will not affect the "teaching" procedure, since in fact the brush is stationary during teaching, nevertheless conveniently at this time also four values S1, S2, S3, S4 are selected from sixteen values for the speed of rotation of the brush, the sixteen values being in a range from 1500 to 3000 rpm. Again, once selected speeds have been associated with these values, the "teaching" procedure is simplified so far as concerns also the speed of rotation of the brush.

The next step in the "teaching" procedure is then to place a model shoe in the shoe support 18 and to move the shoe support to a start position, which is such as to bring the leading, i.e. heel, end of the shoe bottom to a position beneath the selected brush 168, whereafter the latter is lowered into engagement with the shoe bottom under the control of the operator using the manual control device. At this stage, furthermore, the operator selects one of the four "pressure" values P1, P2, P3, P4 and one of the four values "speed rotation" values S1, S2, S3, S4 for the selected point of engagement. When the brush engages the shoe bottom, it is displaced from its defined heightwise position and this will be indicated by the indicator lamp. At this stage the operator can adjust the plane of the brush about the fulcrum pins 154 (theta-movement) in order to ensure that the plane lies perpendicular to the shoe bottom at the point of engagement. When the operator is satisfied with the position of the brush in all respects, he operates a "teach" button whereby the coordinate axis values for the three coordinate axes, together with the angle of theta movement are digitised and the digitised values, together with the selected P value and the S value are stored. Operation of the "teach" button is also effective to raise the brush out of engagement with the shoe bottom and to effect a predetermined amount of lengthwise movement of the shoe support relative to the shoe, as fully described in U.S. Pat. No. 4,541,054. This procedure is then repeated for selected points around the whole of the periphery of the shoe bottom.

The piston-and-cylinder arrangements 175, whereby downward pressure is applied to each of the tools 168, are connected each to a binary-controlled electropneumatic regulator valve; the particular valve used in the machine now being described is a WABCO WESTINGHOUSE valve identified by the designation ND3. This valve has connected therewith a plurality of solenoids (in the particular instance six in number) and, according to the selection of the P value made, actuation of one or more of the solenoids is effected to give the desired pressure output.

For varying the speed of rotation of the brush 168, furthermore, the motor 300 is an a.c. induction motor which is driven by an inverter (not shown); as will be appreciated, the input of a voltage to the inverter will result in a corresponding output speed of rotation of the motor. The sixteen values from which four are to be selected for the speed of rotation of the brush represent sixteen voltages for application to the inverter; thus, by selecting four of these sixteen values, effectively four voltages, and thus four output speeds, are selected.

When the machine is arranged to operate in an operating mode, it will be appreciated, the operator need then only select a given style, e.g. by inputting a style identification, and the various parameters stored in respect of that style, including brush speed and roughing pressure are then read and the operating cycle can be executed on a shoe accordingly. In some circumstances, however, it may be desirable for the "rotation speed" values S1, S2, S3, S4 to be determined when the style has been selected and prior to its execution; it will of course be appreciated that this will not affect the incidence of changes in the speed of rotation, but merely the actual selected speeds of rotation. In accordance with the invention, therefore, instead of the S values being determined at the start of a path-determining mode of operation (or "teach" procedure), they may instead be selected when a style has been selected and prior to its implementation.

In some circumstances it may be desirable to vary all the "pressure" values proportionately as a group; this may occur for example where the all round degree of rough is considered to require increasing or decreasing. To meet such a case the computer control means makes provision for the operator to increase or decrease all the pressures represented by the selected values as a group. More particularly in an editing mode of the machine the operator may select an option for varying all the selected pressures, selection of such option enabling each selected value to be incremented or decreased by up to 3. Thus if for example the selected values P1, P2, P3, P4 are set as, say, 5,6, 7, 4 respectively, if the selected incremental value is, say, 2, then P1, P2, P3, P4 are incremented to 7, 8, 9, 6 respectively. When such variation is made, then the newly established values remain as part of the particular style data until the machine is switched off. These values may of course be "saved", in which case they then form part of the style data stored in non-volatile memory.

A similar "global" variation facility is also provided in the machine for the setting of the brush rotation speeds.

In order to ensure that the brushes 168 are maintained in a suitable sharpened condition for roughing, the machine in accordance with the invention also comprises grinding means, comprising two grinding stones (not shown), one for each brush, the stones being arranged side-by-side and spaced apart by the same, or substantially the same, spacing as between the roughing brushes 168. In general, the grinding stones are stationary, except that they can be manually indexed, but in an alternative form they may be caused to rotate in contrary directions to one another, the direction of rotation in each case being such that, when engaged by a rotating roughing brush 168, the operating surface of each stone is moving in the same direction as the operating surface of the roughing brush engaged thereby, but at a greater speed. Because grinding takes place from time to time, it will be appreciated, the actual overall dimension of the roughing brush will gradually decrease, quite apart from any wear of the brush caused by roughing operations being effected thereby. It will further be appreciated that, as the overall diameter of the brush diminishes, the peripheral speed, i.e. the speed of the surface portion in contact with the shoe relative to the shoe, will also decrease for a given output speed of the motor 300.

In order to compensate for such changes in peripheral speed, therefore, whenever a "re-set" procedure of the machine in accordance with the invention is initiated (usually at the start of a working shift), a procedure is followed whereby the diameter of the brush is "read" and from such measurement a proportion factor is calculated which is then applied to the voltages supplied to the inverter as aforesaid. More particularly, for measuring the diameter of the brush, firstly a datum (not shown), in the form of a proxy switch, is provided which senses the operating edge of a brush supported in the machine. In addition, the computer control means has a "taught" position for the brush centre which is spaced from said datum by a known distance, in the present case 75 mm.

In a re-set procedure, firstly by the operation of the stepping motor 186 the arms 156 are raised to an upper datum position; this may be determined by engagement of the pins 173 in their slots 171, or alternatively by e.g. a proxy switch. With the brushes in this position the arm 30 is then lowered under the control of the third stepping motor referred to above to the "taught" initial position, i.e. with the centre spaced 75 mm from the lower datum. The stepping motor 186 is then again operated to lower the arm 166 until the operating surface portion of the brush is sensed by the proxy switch constituting the lower datum, the number of steps of said motor being counted. In this way, the diameter of the brush can be calculated.

The actual diameter thus measured is then compared with a fixed brush diameter. This may be selected in any manner, but preferably a brush diameter is selected which is judged to be half-way between a full size brush and the smallest diameter of brush which can be accommodated. Thus, a diameter of, say, 120 mm may be selected as a "standard". It will be appreciated that the selected brush speeds, i.e. the speed of rotation of the brush, has to be set against a given standard to achieve a desired peripheral speed, and a standard of 120 mm diameter has been found acceptable in this regard.

In comparing the actual measured diameter of the brush with the standard diameter a proportional factor is thus achieved and, in order to vary the speed of rotation of the output shaft of the motor 300 in order to maintain the peripheral speed of the brush at a constant, it is then merely necessary to divide the voltage supplied to the inverter by the proportional factor. It will of course be appreciated that at the same time the product of this division is then multiplied by the S value selected for each point to provide the desired peripheral speed of the brush for each selected point.

In this way, it will be appreciated, the peripheral speed of the brush can be maintained at a desired constant for each selected "rotational speed" setting.

The second machine now to be described is generally similar, except as hereinafter described, to the machine described in EP-A-0 351 993 with reference to FIGS. 1 to 4 thereof, i.e. the first of the two machines described in that specification. Moreover, the second machine in accordance with the invention is generally similar, so far as concerns the tool supporting means 26 and the stepping motor drive arrangements for effecting movement of the tool supporting means along three coordinate axes, to the first machine described above.

Figure 3:
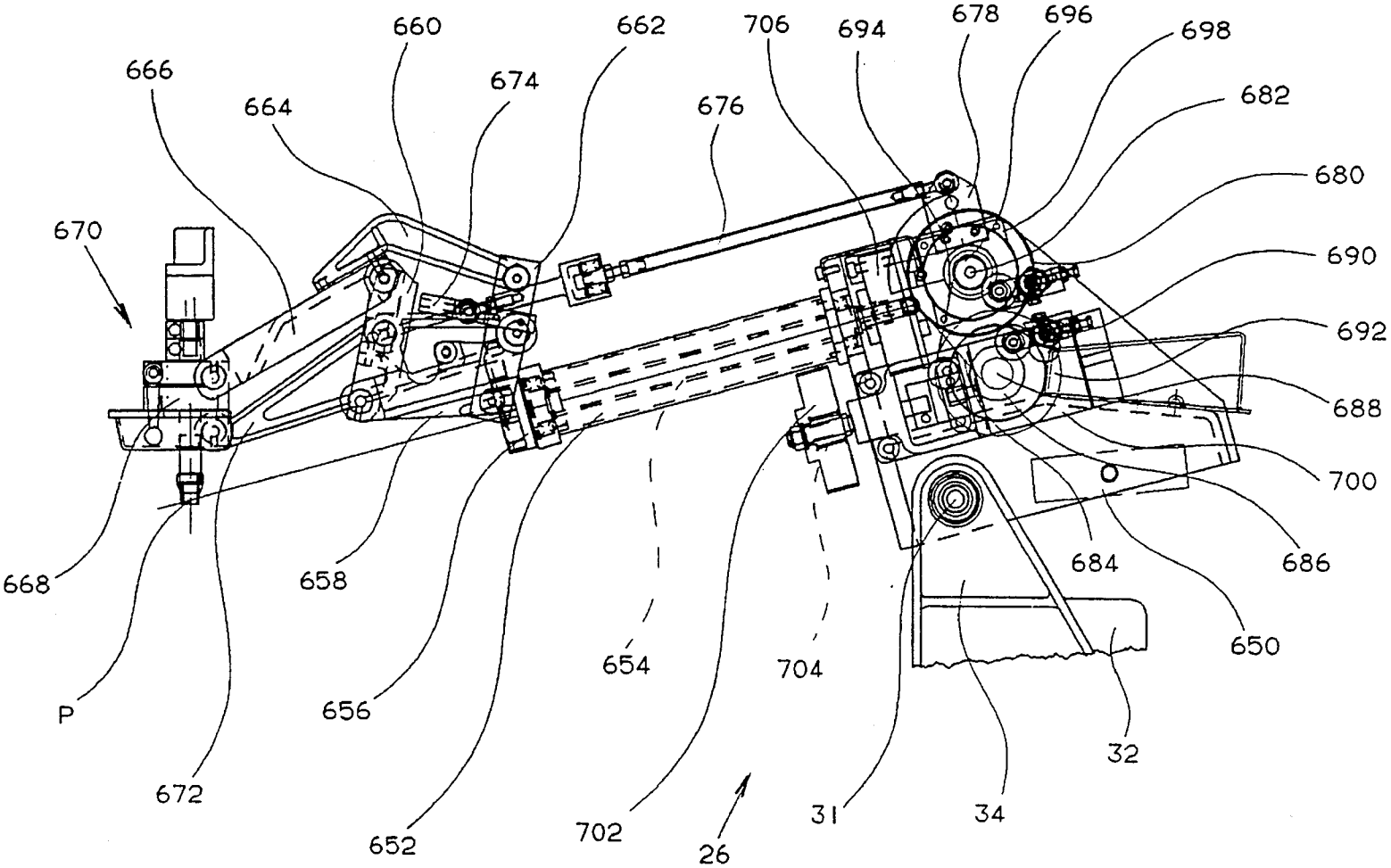
FIG. 3 is a view in side elevation of a tool support arrangement of a second machine in accordance with the invention, showing an adhesive-applying tool and a mounting thereof.
Figure 4:
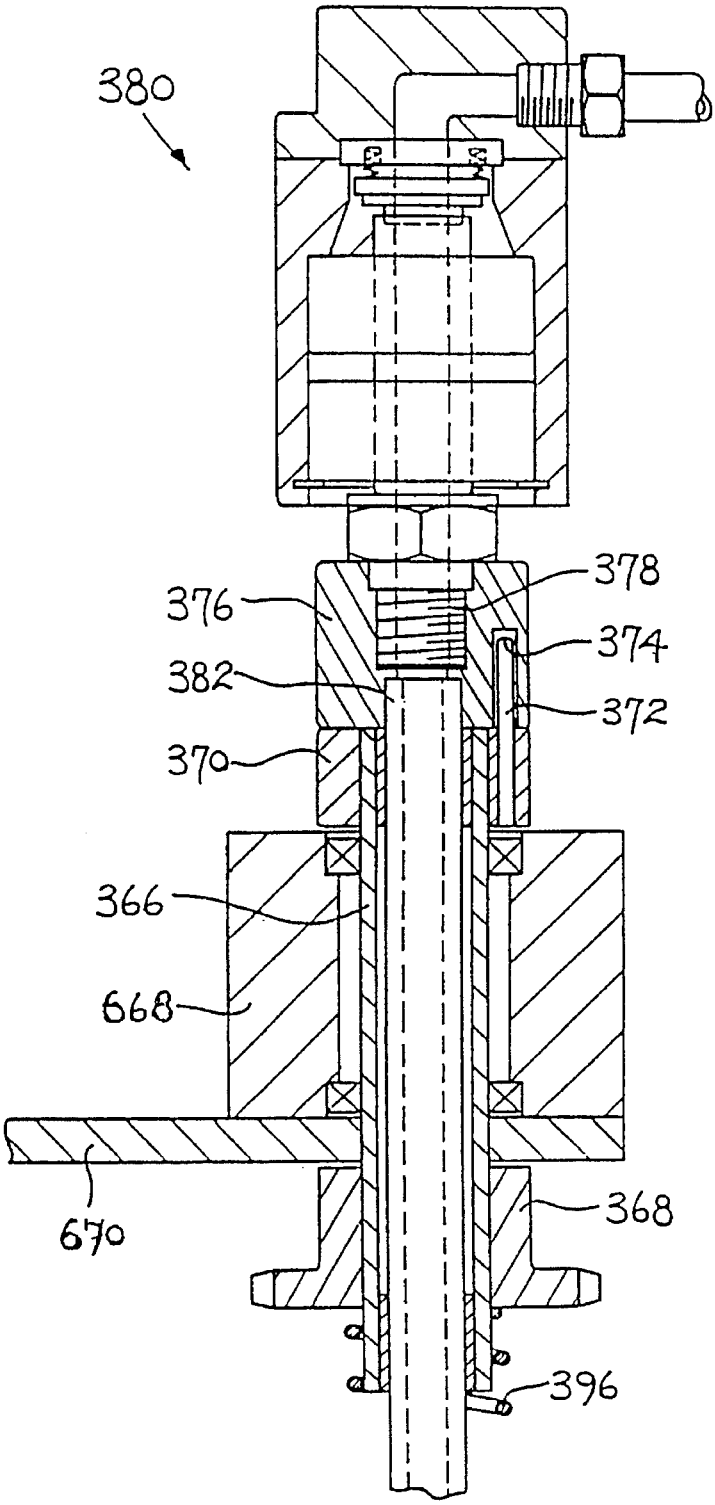
FIG. 4 is a fragmentary view, partly in section, showing details of the tool shown in FIG. 3.

With reference to FIG. 3, the tool supporting means 26 of the second machine in accordance with the invention comprises a housing 650 mounted for pivotal movement about a horizontal axis 31. From a forward face of the housing projects a hollow, tubular arm 652 within which is accommodated, for rotation movement therein, a support 654. At the forward end of said rod is a plate 656 supporting two forwardly projecting arms 658, which are spaced apart widthwise of the machine and on each of which is mounted, for pivotal movement, a pair of links 660, 662, upper ends of which pivotally support a plate 664. The links 660, 662 together with the plate 664 and arms 658, thus comprise a first parallel linkage arrangement of the tool supporting means.

Fixedly secured to a forward end of the plate 664, and projecting forwardly therefrom, is a further plate 666, in a forward, bifurcated, end of which is pivotally mounted a block 668 forming part of a tool carrier or holder generally designated 670. Also secured to the tool holder, at the left-hand side thereof, is a further link 672 which is in turn pivotally connected to each of the left-hand links 660, 662. The links 660, 662, tool holder 670, link 672 and composite plate 664, 666 thus constitute a second parallel linkage of the tool supporting means. The various pivots are so arranged in relation to one another than the tool holder is caused to pivot about an axis (a virtual centre) which passes through a point P, through which point also passes the axis of the support rod 654. As will be described hereinafter, furthermore, when a tool is supported in the tool holder 670, the axis of rotation thereof also passes through said point P. The point P represents a height datum of the machine in a desired relationship with which the bottom of a shoe supported by the shoe support can be positioned by means of a holddown member (not shown) and toe support means (not shown) of said support.

For effecting such pivotal, or tilting, movement of the tool holder 670 about the transverse axis, the links 662 carry therebetween a block 674 to which is pivotally connected a forward end of a push-rod 676, the rearward end of which is similarly pivotally connected to a block 678 which is mounted on a pulley 680 freely rotatable about a drive shaft 682. The pulley 680 is caused to rotate about said shaft by a timing belt 684 entrained around a second pulley 688. A tensioning pulley 690 being provided for maintaining the tension in the belt. Also mounted on the shaft 698 is a third pulley 692 around which is entrained a second timing belt 694 meshing with a fourth, drive, pulley 696 secured by the drive shaft 682. The shaft 682 is driven by a stepping motor 698.

For effecting rotational movement of the support rod 654, a similar drive arrangement is provided comprising a stepping motor 700 acting through four pulleys 702, 704, 706 (the fourth not being shown) and timing belts (not shown), the pulley 706 being fixedly mounted on the support rod 654.

Figure 5:
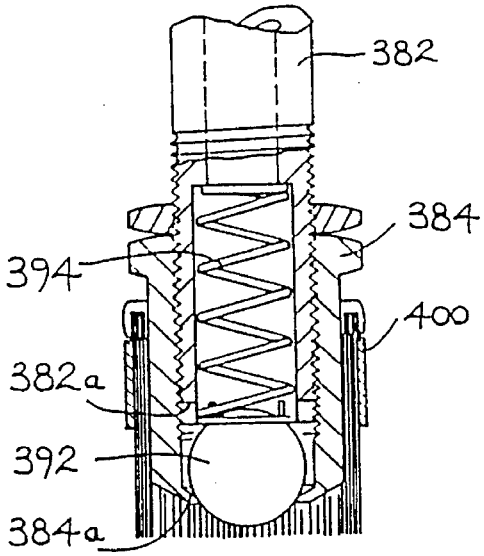
FIGS. 5 and 6 are fragmentary views showing a ball of the tool shown in FIG. 4, respectively in a sealing position and moved out of said position by engagement with the shoe bottom.
Figure 6:
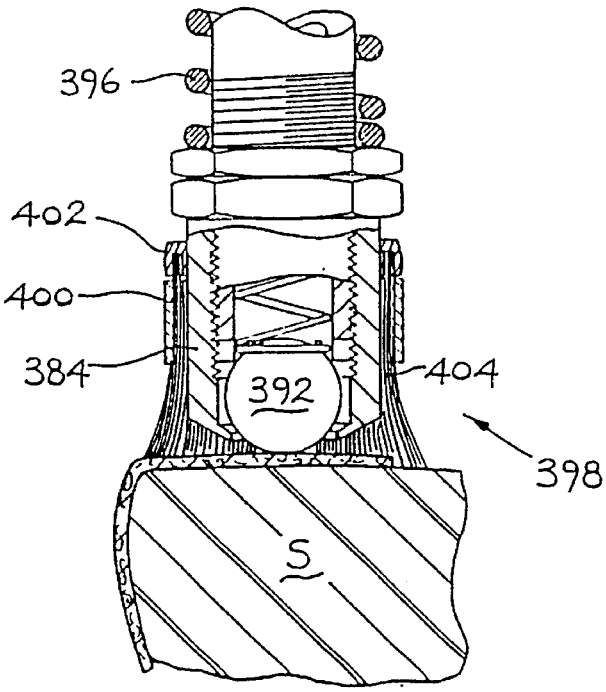

The tool holder 670 is arranged to support a tool in the form of an U.S. Pat. No. 4,836,139 adhesive applicator device generally as described in EP-A-0 276 944, the us equivalent being, the tool being fixedly mounted in the block 668. (The mounting arrangement is generally similar to the alternative mounting arrangement referred to in the aforementioned specification). The adhesive applicator device thus comprises a hollow shaft 366 (FIG. 4) mounted in the block 668 and carrying at its lower end a sprocket 368 pivotally connected by a chain (not shown but numbered 386 in said specification) to an electric motor also carried on the tool holder 670. At its upper end the shaft 366 carries a collar 370 in which is secured an upstanding pin 372 accommodated in a bore 374 of a further collar 376 which is threadedly secured to an output end 378 of a rotary coupling generally designated 380; one such coupling is available commercially from Deublin Limited. Force-fitted into the collar 376, furthermore, is the upper end of an adhesive supply tube 382 which passes through the hollow shaft 366 and has screw-threaded on the lower end thereof a nozzle housing 384 (see FIGS. 5 and 6). It will thus be appreciated that rotation of the sprocket 368 causes, through the pin 372 and bore 374, rotation of the tube 382 and thus of the nozzle housing 384 secured thereto.

The nozzle housing 384 has a frustoconical lower end face **384*a* which provides an annular rim spaced from the lower end face 382*a* of the tube 382 to form therein a chamber in which a ball 392 is accommodated with a portion thereof projecting beyond the annular rim. A spring 394 is accommodated in a counter-sink formed in the lower end of the tube 382 and urges the ball against the annular rim into a sealing position in which adhesive flow through the nozzle is prevented. The application of pressure to the projecting portion of the ball 392, on the other hand, causes it to retract against the lower end 382*a*** of said counter-sink, which is slotted so as to allow adhesive flow from the tube when the ball is urged thereagainst, such adhesive then flowing over the surface of the ball and out between the annular rim and the projecting portion of the ball.

It will thus be appreciated that, in using the second machine in accordance with the invention, pressing the ball 392 against a component to be coated with adhesive causes the ball to retract, to allow adhesive to be supplied through the nozzle, the supply continuing until the ball is moved out of contact with the component whereupon sealing takes place substantially immediately with consequent cut-off of the adhesive. The ball is shown in its retracted condition in FIG. 6.

The nozzle housing 384 is capable of "floating" relative to the bearing block 364, that is to say excessive pressure applied to the ball is accommodated by sliding movement of the nozzle housing bodily in relation to the hollow shaft 366, so that any irregularities in the surface of the shoe bottom to be coated with adhesive, in relation to the heightwise path as determined by the third n.c. motor, can be accommodated. To ensure that the nozzle housing is urged into its lowered position, a further spring 396 is provided acting between the nozzle housing the underside of the hollow shaft. It will of course be appreciated that the force applied by the spring 396 is significantly greater than that applied by the spring 394, so as to ensure that the ball will first retract when engaged. As can be seen from FIG. 3, when the housing is in its lowermost position it lies below the point P. In a digitising operation, however, in setting the Z-axis position desirably the operative surface portion of the tool is set at the point P, that is to say a certain amount of the "float" is taken up during digitising, thereby allowing variations of a plus or minus value from that position to take place according to any irregularities in the contour of the shoe bottom. Conveniently for determining the amount of float, the operator, when carrying out a digitising procedure, has regard to the distance between the two collars 370, 376. If desired, furthermore, a scale may be provided on one of the collars to assist the operator.

For spreading the adhesive which is supplied through the nozzle, a brush assembly generally designated 398 is secured to the outside of the nozzle housing 384, e.g. by a Jubilee clip 400. The brush assembly 398 comprises a ring 402, e.g. of plastics material, which is slid along the nozzle housing and in which are embedded sets of bristles 404 arranged to form a cylindrical shape which surrounds the nozzle housing and projects beyond the end fact **384*a*, being disposed about the whole of the periphery of said end face 384*a*. By virtue of its being fixed to the housing as aforesaid, the brush assembly 398 rotates with the nozzle housing 384**.

The second machine in accordance with the invention is, as in the case of a first machine, computer-controlled, the computer having a storage memory for storing digitised information relating to a number of selected styles of shoe bottoms to be operated upon, to be accessed by the operator in the same manner as with the first machine. In the case of the second machine, in addition to controlling the path of the tool about three coordinate axes, the computer supplies drive signals, in the form of control pulses, to the stepping motors 698, 700, whereby the nozzle housing 384 is caused to pivot about the point P, in accordance with the programmed instruction, which in this case also includes digitised information relating to the angles of inclination about the point P.

As with the first machine, furthermore, the various stepping motors and the computer-control means thereof are also utilised in a path-determining mode of operation for determining the operative path of the tool holder 670 in relation to the shoe support, the path being determined using a model shoe supported in the shoe support. When the second machine is in said path-determining mode, furthermore, a facility is provided for varying, according to the type of upper material to be used in the shoe to be operated upon, the pressure applied in the adhesive supply system (and thus the adhesive flow rate), the speed of rotation of the brush assembly 398 and also the direction of such rotation. Moreover, such variation is capable of being made not only between successive operating cycles, but also during a single operating cycle. To this end, therefore, the apparatus in accordance with the invention also provides means for setting the speed of rotation of the brush assembly 398, the direction of such rotation and also the pressure applied in the adhesive supply system for each digitised point.

More particularly, for determining the pressure applied in the adhesive supply system a facility is provided for the operator to select four values AP1, AP2, AP3, AP4, from a range of twenty-five pre-set values. Each of these twenty-five values represents a different pressure in a range from zero to 30 psi). It has been found that selecting four such values will normally be sufficient for operating along a shoe; it will of course be appreciated that more than four values could be selected if required. By associating a selected pressure with each of the values, moreover, the "teaching" procedure can then be significantly simplified.

At the same time, a further facility is provided for the operator to select four values AS1, AS2, AS3, AS4 from sixteen such values for the speed of rotation of the brush assembly 398, these sixteen values representing from 0 to 500 r.p.m. Again, once selected speeds have been associated with the values, the "teaching" procedure is simplified so far as concerns also the speed of rotation of the brush assembly. In addition, a further facility of selecting one of two settings for the direction of rotation of the brush assembly is also provided.

In carrying out the "teaching" procedure, firstly with a model shoe supported in the shoe support 18, the shoe support is moved to a start position which is such as to bring the leading, i.e. heel, end of the shoe bottom to a position beneath the brush assembly 398, whereafter the latter is lowered into a desired position, lengthwise, widthwise and heightwise of the shoe bottom, in engagement therewith, under the control of the operator using the manual control device. Also at this stage the tool holder 670 can be pivoted in two directions about the point P, thus to set the "tilt" and "camber" positions of the tool, and at this time also the operator selects one of the four values AP1, AP2, AP3, AP4 for selecting an appropriate pressure for the adhesive supply system, one of the four values AS1, AS2, AS3, AS4 for the speed of rotation of the brush assembly 398, and one of the two settings for the direction of rotation of the brush assembly. When the operator is satisfied with the position in all respects, he operates a "teach" button, whereby the coordinate axis values for the three coordinate axes, together with the information relating to the angular disposition about two axes, are digitised and the digitised values, together with the selected AP value, the selected AS value and the selected setting are stored. Operation of the "teach" button is also effective to raise the brush assembly out of engagement with the shoe bottom and to effect a predetermined amount of lengthwise movement of the shoe support relative to the shoe, as fully described in U.S. Pat. No. 4,541,054. This procedure is then repeated for selected points around the whole of the periphery of the shoe bottom.

The adhesive supply system comprises a variable flow regulator valve for varying the rate of flow of adhesive through the system. In the apparatus now being described, the regulator arrangement comprises a binary-controlled electro-pneumatic regulator valve; the particular valve used is a WABCO WESTINGHOUSE valve identified by the designation ND3. This valve has connected therewith a plurality of solenoids (in the particular instance six in number) and, according to the selection of the AP value made, actuation of one or more of the solenoids is effective to give the desired pressure output.

For varying the speed of rotation of the brush assembly 398, furthermore, the electric motor (not shown) by which the nozzle housing 384, and thus the brush assembly 398, is caused to rotate, is an a.c. induction motor which is driven by an inverter (not shown); as will be appreciated, the input of a voltage to the inverter will result in a corresponding output speed of rotation of the motor. The sixteen values from which four are to be selected for the speed of rotation of the brush assembly represent sixteen voltages for application to the inverter; thus, by selecting four of these sixteen values, effectively four voltages, and thus four output speeds are selected. For controlling the direction of rotation of the brush assembly 398, furthermore, a relay-operated switch arrangement (not shown) is incorporated in the supply circuit to the a.c. induction motor, whereby the polarity of the motor can be switched according to the selected setting.

When the second machine in accordance with the invention is arranged to operate in an operating mode, it will be appreciated, the operator need then only select a given style, e.g. by inputting a style identification, and the various parameters stored in respect of that style, including the speed of rotation of the brush assembly and its direction, and also the pressure to be applied in the adhesive supply system, are then read and the operating cycle can be executed on a component accordingly.

Whereas the invention has been described in connection with machines for operating progressively along marginal portions of shoe bottoms, and indeed more particularly for performing a roughing operation therealong and for applying adhesive to marginal portions thereof, it will be appreciated that the invention in its broader aspects is equally applicable to other machines. So far as shoe making is concerned, furthermore, other areas of application of the invention would include side wall roughing machines and sidewall cementing machines.

We claim:

1. A method of controlling the progressive operation of a tool of a shoe machine on a selected portion of a shoe, wherein the tool is caused to follow a predetermined path in relation to a selected portion of the shoe and, as the tool thus operates progressively on said selected portion at least one parameter relating to the operation of the tool other than in respect of its position can be varied, said method comprising:

defining a plurality of selected points, said points together providing a predetermined operating path of the tool, each such point being defined by its coordinate axis values;

establishing and pre-setting a limited number of values for each of said at least one parameter for each of said points, each such value being provided with an identification, one of said values being thus selectable for each point by selecting its identification;

selecting a value for said at least one parameter for each point defined as aforesaid, wherein a limited number of values is pre-set for the at least one parameter;

storing the coordinate axis values and the selected identification for subsequent recall, the said values and identifications for all the defined points constituting a programmed instruction; and implementing said programmed instruction to cause the tool to operate progressively along its path and to vary said at least one parameter during such progressive operation.

2. Method according to claim 1 wherein the limited number of values for the at least one parameter is selected from a range of such values therefor, each of the selected values being allocated to an identification.

3. A method of controlling the progressive operation of a rotary radial roughing brush on a selected portion of a workpiece, wherein the brush is caused to follow a predetermined path in relation to the selected workpiece portion, said method recomprising defining a plurality of selected points, said points together providing a predetermined operating path of the brush, each such point being defined by its coordinate axis values;

establishing and pre-setting a value for the speed of rotation of the roughing brush, storing said coordinate axis values and the pre-set values for the speed of rotation of the brush for subsequent recall said values constituting a programmed instruction;

determining the diameter of the roughing brush and modifying the pre-set value for the speed of rotation of the brush according to its diameter as thus determined; and implementing said programmed instruction, but with said preset value thus modified, to cause the brush to operate progressively along its path.

4. Method according to claim 3 wherein as the brush thus operates progressively along the selected workpiece portion the speed of rotation of the brush can be varied, the method comprising establishing and pre-setting a limited number of values for the speed of rotation of the brush for each of said defined points, each such value being provided with an identification, one of said values being thus selectable for each point by selecting its identification;

storing each such selected value with the defined points are the selected values for the speed of rotation of the brush thus forming part of the programmed instruction;

modifying each such pre-set value for the speed of rotation of the brush according to its diameter as thus determined; and implementing said programmed instruction, but with the selected values for the speed of rotation of the brush thus modified, to cause the brush to operate progressively along its path.

5. A method of controlling the progressive operation of a tool on a selected portion of a workpiece in a machine comprising a shoe support, a tool carrier for supporting a rotary tool, drive means for effecting rotation of such tool, first and second n.c. motor means for effecting relative movement, both lengthwise and widthwise of a shoe supported by the shoe support, between the shoe support and the tool carrier, third n.c. motor means for controlling the heightwise position of the tool carrier relative to the shoe support, as relative lengthwise and widthwise movement is caused to take place therebetween, wherein the tool is caused to follow a predetermined path in relation to the selected workpiece portion and, as the tool thus operates progressively on said selected portion, at least one parameter relating to the operation of the tool other than its position can be varied, said method comprising:

operating a path-determining means in a path-determining mode of the machine, whereby, by a control device, relative movement is caused to take place along the three coordinate axes between the shoe support and tool carrier to bring them successively to a plurality of selected points along the marginal portion of such shoe, said points together providing a predetermined operating path of the tool, each such point being defined by its coordinate axis values, digitizing the coordinate axis values of each such selected point, establishing and pre-setting a limited number of values for said at least one parameter for each of said selected points, each such value being provided with an identification, and one of said values thus being selectable for each selected point by selecting its identification, selecting, using a selector means, for each point an identification representing a value for said at least one parameter, said identifications also forming part of the programmed instruction, storing said coordinate axis values and selected identifications in a computer controlled means for subsequent recall, said values and identifications for all the defined points constituting a programmed instruction, and implementing said programmed instruction, by generating drive signals and supplying said drive signals to said motors in accordance therewith, to cause the tool to operate progressively along its path and to vary said at least one parameter during such progressive operation.

6. A method of controlling the progressive operation of a tool on a selected portion of a workpiece, wherein the tool is caused to follow a predetermined path in relation to the selected workpiece portion and, as the tool thus operates progressively on said selected portion, at least one parameter relating to the operation of the tool other than its position can be varied, said method comprising:

defining a plurality of selected points, said points together providing a predetermined operating path of the tool, each such point being defined by its coordinate axis value;

establishing and pre-setting a limited number of values for said at least one parameter for each of said points, each such value being provided with an identification, one of said values thus being selectable with a selector means for each point by selecting its identification;

storing said coordinate axis values and selected identification for subsequent recall, said values and identifications for all the defined points constituting a programmed instruction;

implementing said programmed instruction to cause the tool to operate progressively along its path and said at least one parameter to be varied during such progressive operation;

the implementation of said instruction being on a machine comprising a shoe support, a tool carrier for supporting a rotary tool, drive means for effecting rotation of said tool, first and second n.c. motor means for effecting relative movement, both lengthwise and widthwise of a shoe supported by the shoe support, between the shoe support and the tool carrier, third n.c. motor means for controlling the heightwise position of the tool carrier relative to the shoe support, as relative lengthwise and widthwise movement is caused to take place therebetween;

generating drive signals and supplying said drive signals to said motor in accordance with said programmed instruction;

operating a path-determining means in a path-determining mode of the machine; and causing, by a control device, relative movement to take place along the three coordinate axes between the shoe support and tool carrier to bring them to successive selected points along the marginal portion of such shoe, together with means for digitizing the coordinate axis values of each such selected point.

7. Method according to claim 6 wherein said at least one parameter is the speed of rotation of the tool.

8. Method according to claim 6 wherein said tool is supported by a tool carrier for heightwise movement relative to a shoe supported by the shoe support, including the step of resiliently urging said tool carrier in a direction towards the shoe support, and wherein said at least one parameter is the pressure applied to the tool.

9. Method according to claim 6 wherein the tool is a radial roughing brush, and wherein the diameter of the brush is determined; and modifying the speed of rotation of the brush, selected as aforesaid, according to its diameter as thus determined.

10. Method according to claim 6 wherein the drive means comprises an a.c. motor controlled by an invertor;

supplying a voltage to the invertor to effect operation of the motor and thus varying the output speed of the motor with the value of the voltage supplied to the invertor, the rotational speed of the rotary tool being values selected as aforesaid and corresponding to values for the voltage supplied to the invertor.

11. Method according to claim 6 comprising modifying the voltage supplied to the invertor according to a modifying factor representing the diameter of the brush.

12. Method according to claim 6 wherein the tool comprises an adhesive-applying device and means for supplying adhesive thereto, and wherein said at least one parameter is the rate of flow of adhesive supplied to the tool.

13. Method according to claim 12 including the step of controlling the rate of adhesive flow rate by a variable pressure regulator the adhesive flow rate.

14. Method according to claim 6 wherein the tool comprises an adhesive-applying device incorporating a rotary brush assembly, and wherein said at least one parameter is the direction of rotation of the brush.

* * * * *